US008641108B2

(12) United States Patent
Surber et al.

(10) Patent No.: US 8,641,108 B2
(45) Date of Patent: Feb. 4, 2014

(54) ANIMAL WASTE COLLECTION APPARATUS AND METHOD OF USE

(76) Inventors: Edward Surber, Overland Park, KS (US); Eric Devorak, Leawood, KS (US)

( * ) Notice: Subject to any disclaimer, the term of this patent is extended or adjusted under 35 U.S.C. 154(b) by 130 days.

(21) Appl. No.: 13/407,231

(22) Filed: Feb. 28, 2012

(65) Prior Publication Data

US 2013/0223970 A1 Aug. 29, 2013

(51) Int. Cl.
*A01K 29/00* (2006.01)
*E01H 1/12* (2006.01)

(52) U.S. Cl.
USPC ..... 294/1.3; 294/25

(58) Field of Classification Search
USPC ..... 294/1.3, 1.4, 1.5, 25, 55; 15/257.1, 15/104.8, 227; 383/4; D30/162
See application file for complete search history.

(56) References Cited

U.S. PATENT DOCUMENTS 4,741,565 A * 5/1988 Bagg ..... 294/1.3
5,836,629 A * 11/1998 Hobart ..... 294/1.3
5,864,883 A 2/1999 Reo
6,116,668 A 9/2000 Carpol
6,203,080 B1 3/2001 Surplus
D460,223 S * 7/2002 Daniels ..... D30/162
6,832,796 B1 * 12/2004 Minassians ..... 294/1.3
7,854,694 B1 12/2010 Frunzi
2003/0150750 A1 8/2003 Begim et al.
2005/0052037 A1 3/2005 Spuck

* cited by examiner

*Primary Examiner* — Paul T Chin
(74) *Attorney, Agent, or Firm* — Dale J. Ream

(57) ABSTRACT

An animal waste collection apparatus includes a housing having side and end walls defining an open top, bottom, and interior area. A bottom panel is pivotally coupled to a lower edge of one of the side walls and movable between an open configuration not covering the open bottom and a closed configuration covering the open bottom. A collection member includes a mounting portion completely covering the housing open top and a collection portion extending downwardly into the interior area, the collection portion being movable between a retracted configuration inside the interior area and an extended configuration outside the interior area through the open bottom for use to collect animal waste. The bottom panel is operatively coupled to the collection portion inside the interior area such that the bottom panel is moved to the closed configuration automatically when the collection portion resiliently moves from the extended configuration to the retracted configuration.

13 Claims, 9 Drawing Sheets

ANIMAL WASTE COLLECTION APPARATUS AND METHOD OF USE

BACKGROUND OF THE INVENTION

The present invention relates generally to animal waste collection devices and, more particularly, to a waste collection apparatus having an impermeable membrane that is selectively extendable outside a housing to collect waste and then retractable to deposit the waste inside the automatically sealed housing.

A common daily task for a dog owner is either to let the dog outside of a house into the backyard or to walk the dog on a leash so that the dog may have a bowel movement outside the house. In either case, the pet owner feels a responsibility (or in some cases a legal mandate) to pick up the waste and dispose of it. Performing this task of collecting and disposing of animal waste is considered both inconvenient and distasteful.

Various devices have been proposed in the art for collecting animal waste without having to simplify the task of collecting the waste, to improve the means for disposing of it, or even to avoid any physical contact with the waste. Although assumably effective for their intended purposes, the existing devices do not provide a housing that enables easy collection of animal waste into a container without any risk of physical contact with it and that automatically seals after the waste is deposited therein.

Therefore, it would be desirable to have an animal waste collection apparatus and method for using it to collect animal waste without any chance of physically touching it and by containing it in an impermeable container for disposal.

SUMMARY OF THE INVENTION

An animal waste collection apparatus according to the present invention includes a housing having opposed first and second side walls and opposed end walls extending between the side walls, respectively, the housing defining an open top, an open bottom, and an interior area. A bottom panel is pivotally coupled to a lower edge of one of the side walls and movable between an open configuration at which the bottom panel is positioned inside the housing interior area so as not to cover the open bottom and a closed configuration in which the bottom panel covers the open bottom.

A collection member includes a mounting portion connected to an upper end of the housing and a collection portion extending downwardly from the mounting portion into the housing interior area, the collection portion being resiliently movable between a retracted configuration inside the housing interior area and an extended configuration extending outside the housing interior area through the open bottom so as to selectively capture animal waste. The bottom panel is operatively coupled to the collection portion such that the bottom panel is moved to the closed configuration when the collection portion resiliently moves from the extended configuration to the retracted configuration. A user is then able to release the animal waste to rest on top of the bottom panel and remove his hand from the collection/glove portion. At that point, the waste is contained inside the housing and may be conveniently and cleanly disposed of.

Therefore, a general object of this invention is to provide an animal waste collection apparatus and method for collecting animal waste in a sterile and convenient manner.

Another object of this invention is to provide a waste collection apparatus and method, as aforesaid, that includes an integrated glove enabling a user to collect animal waste and a container configured to enclose the waste after collection.

Still another object of this invention is to provide a waste collection apparatus and method, as aforesaid, in which the container includes a bottom panel that closes automatically after the glove is returned inside the container after waste collection.

Yet another object of this invention is to provide a waste collection apparatus and method, as aforesaid, that is easy to use and economical to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
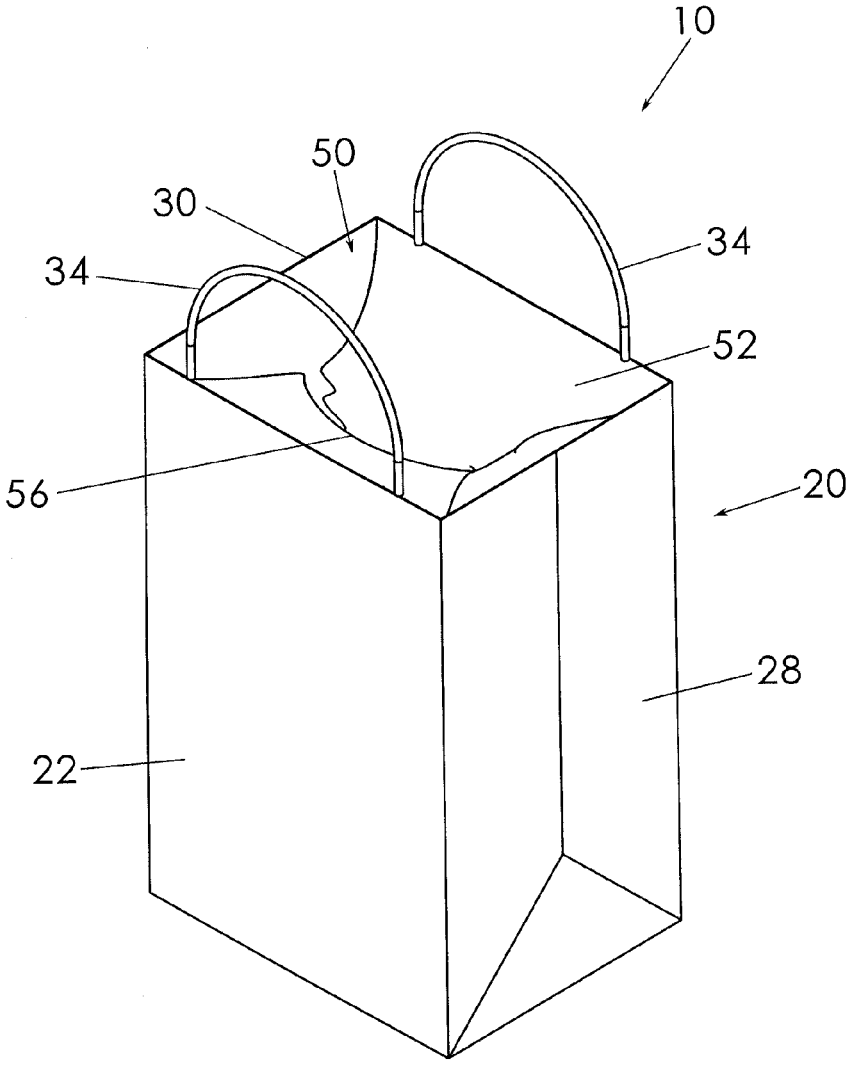
FIG. 1 is a perspective view of animal waste collection apparatus according to an embodiment of the present invention.

A waste collection apparatus and method will now be described with reference to FIGS. 1 to 9*b* of the accompanying drawings. The waste collection apparatus 10 includes a housing 20, a bottom panel 40, and a collection portion 54.

The housing 20 includes opposed first 22 and second 24 side walls and opposed first 28 and second 29 end walls extending between respective lateral edges of respective side walls. Upper edges of respective walls define an open top 30.

Lower edges of respective walls define an open bottom 32. The housing 20 is configured to be moved selectively between a collapsed or generally flat configuration (not shown) and an expanded configuration (FIG. 1). It is apparent that the housing 20 may be maintained in the collapsed configuration when not in use, such as when packaged for sale and for storage before use and then be expanded when ready for use in collecting animal waste as will be described in more detail later. The housing side and end walls may be constructed of a durable yet biodegradable material so that the housing 20 will remain sturdy in use but will degrade when disposed later in a landfill.

Figure 4:
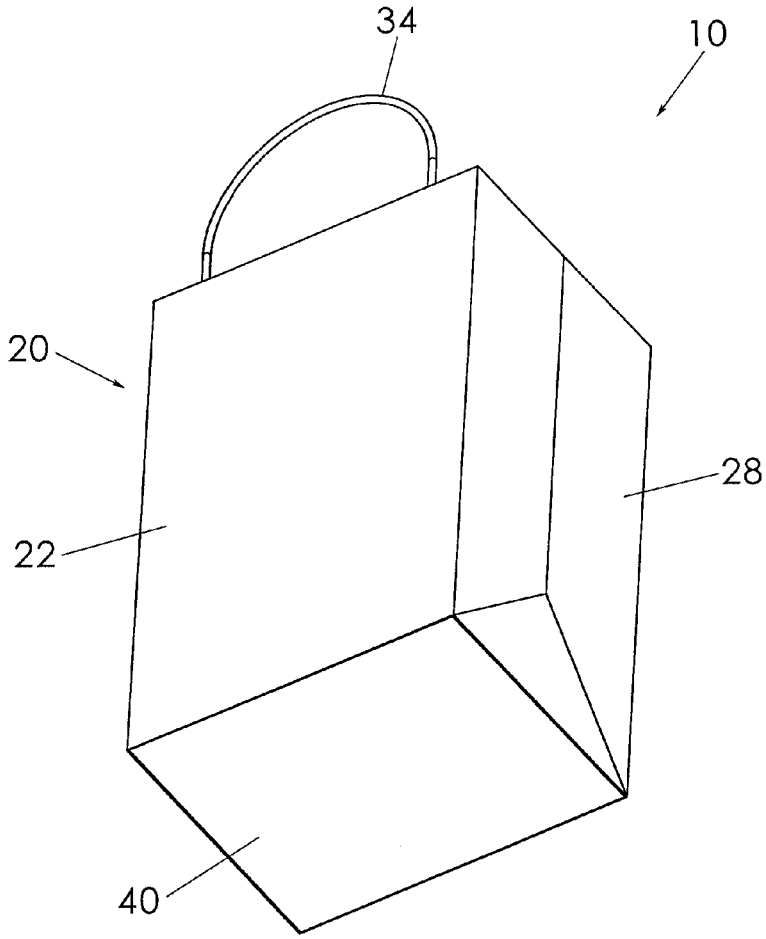
FIG. 4 is a perspective view of the apparatus as in FIG. 3 with the bottom panel at a closed configuration.
Figure 5:
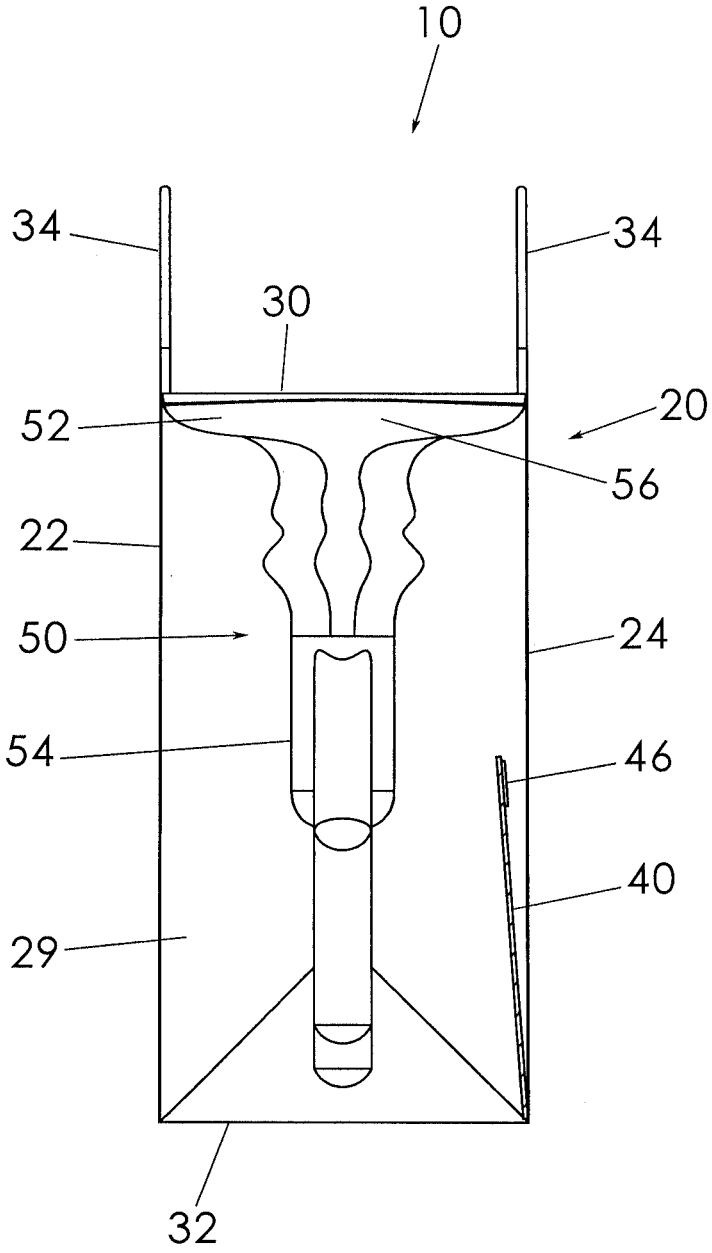
FIG. 5 is an end view of the apparatus as in FIG. 2*a* with an end wall removed for clarity in illustrating the collection member at the retracted configuration and an adhesive attachment of the bottom panel to a housing side wall.

The bottom panel 40 is pivotally coupled to lower edges of one side wall, such as the second side wall 24. Preferably, the bottom panel 40 is connected with an integrated or "living" hinge so that no metal or plastic hardware is required. The bottom panel 40 may be constructed of cardboard or semi-rigid paper stock so as to be strong and durable in use as will be further described later. The bottom panel 40 is movable between an open configuration situated inside the housing interior area so that the open bottom 32 is not covered (FIG. 3) and a closed configuration in which the bottom panel 40 covers the open bottom 32 of the housing 20 (FIG. 4).

Figure 2A:
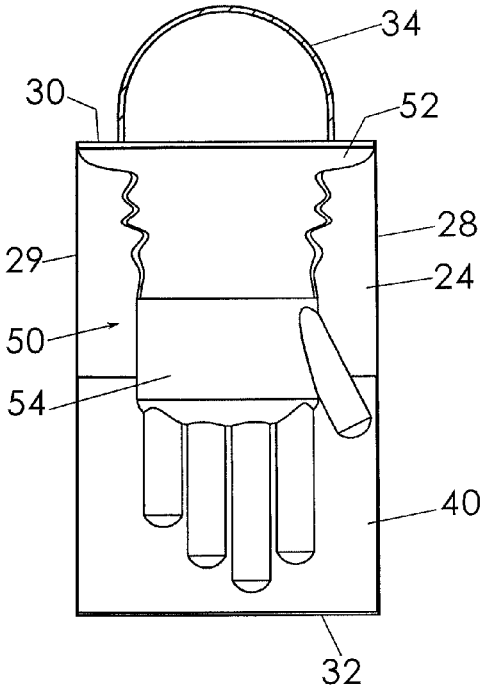
FIG. 2*a* is a side view of the apparatus as in FIG. 1 with a first side wall removed for clarity in illustrating a collection member at a retracted configuration.
Figure 2B:
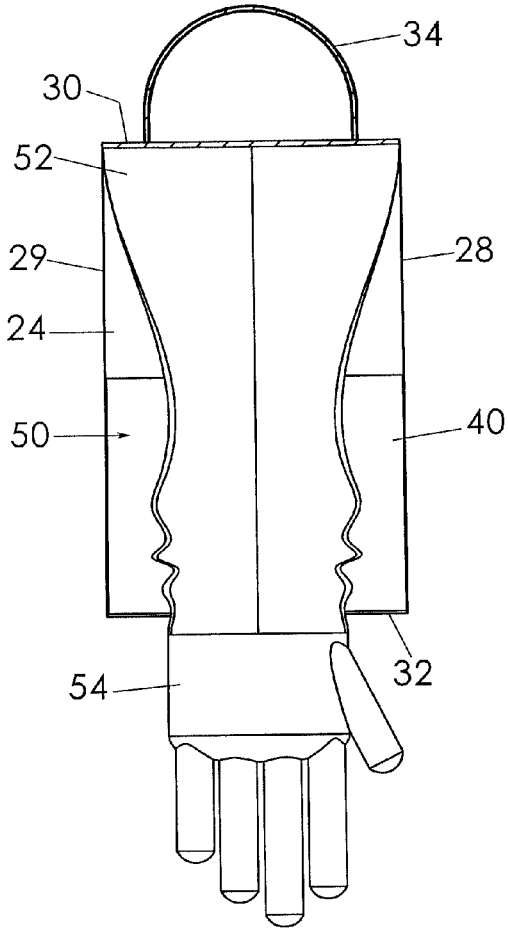
FIG. 2*b* is a side view of the apparatus as in FIG. 2*a* with the collection member at an extended configuration.
Figure 3:
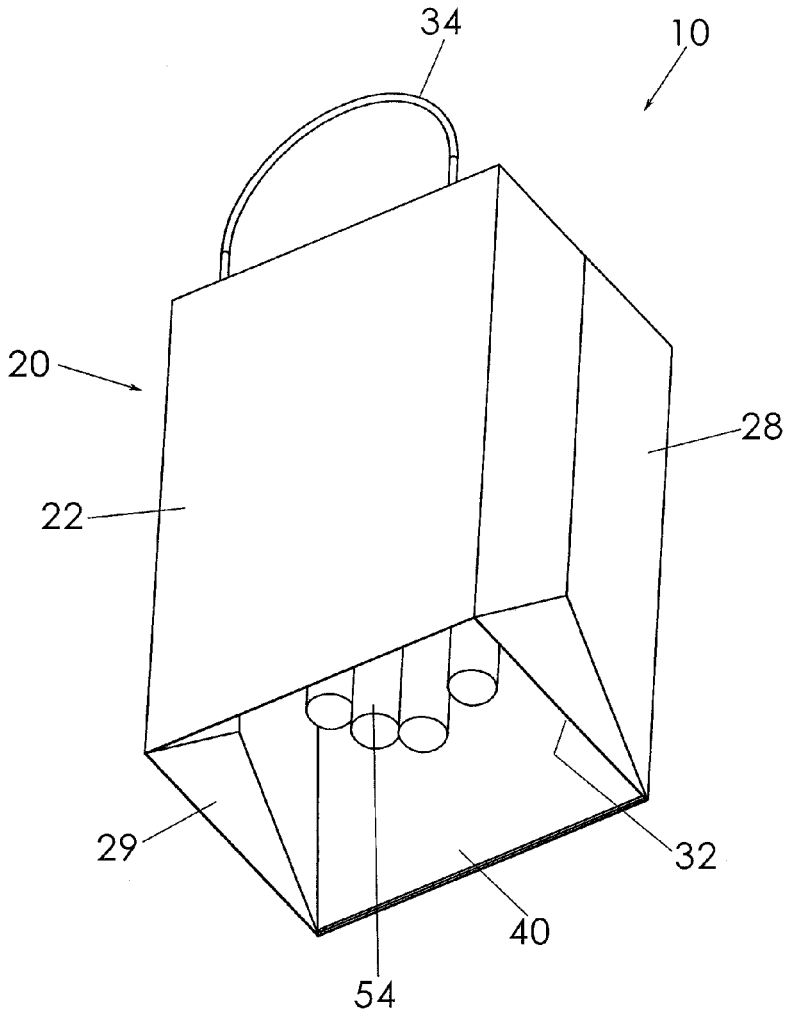
FIG. 3 is a perspective view of the apparatus as in FIG. 1 taken from another angle so as to illustrate a bottom panel of the apparatus housing in an open configuration.

The collection member 50 includes a mounting portion 52 and a collection portion 54. The mounting portion 52 and collection portion 54 may have an integrated or unitary construction and be constructed of a generally flexible and resilient material. The collection member 50 may be generally impermeable to liquid and air and may be constructed of a thin layer of polyvinyl chloride (PVC) plastic or other liquid resistant material. The mounting portion 52 may be connected to an upper end of the housing 20. Specifically, the mounting portion 52 is attached to upper edges of each of the side and end walls and covers the entire housing open top 30. The collection portion 54 is resiliently movable between a retracted configuration situated entirely inside the interior area of the housing 20 (FIG. 2*a*) and an extended configuration extending at least partially outside of the housing interior area through the open bottom 32 (FIG. 2*b*).

The collection portion 54 may have a glove-shaped configuration that may be used by a user to collect animal waste when at the extended configuration. More particularly, the collection portion 54 may form a hand opening 56 adjacent the mounting portion 52 and extending downward to the finger structures so as to appear as a glove that is inverted (i.e. hanging upside down) in the interior area of the housing 20. The collection portion 54 defines an interior area configured to receive a human hand. Accordingly, a user may insert his hand into the glove-like collection portion 54 and urge it to stretch downwardly through the open bottom 32 until it is substantially outside of the housing interior area where the user may use the fingers to grasp animal waste. The user may then move the collection portion 54 back inside the housing interior area.

Figure 8:
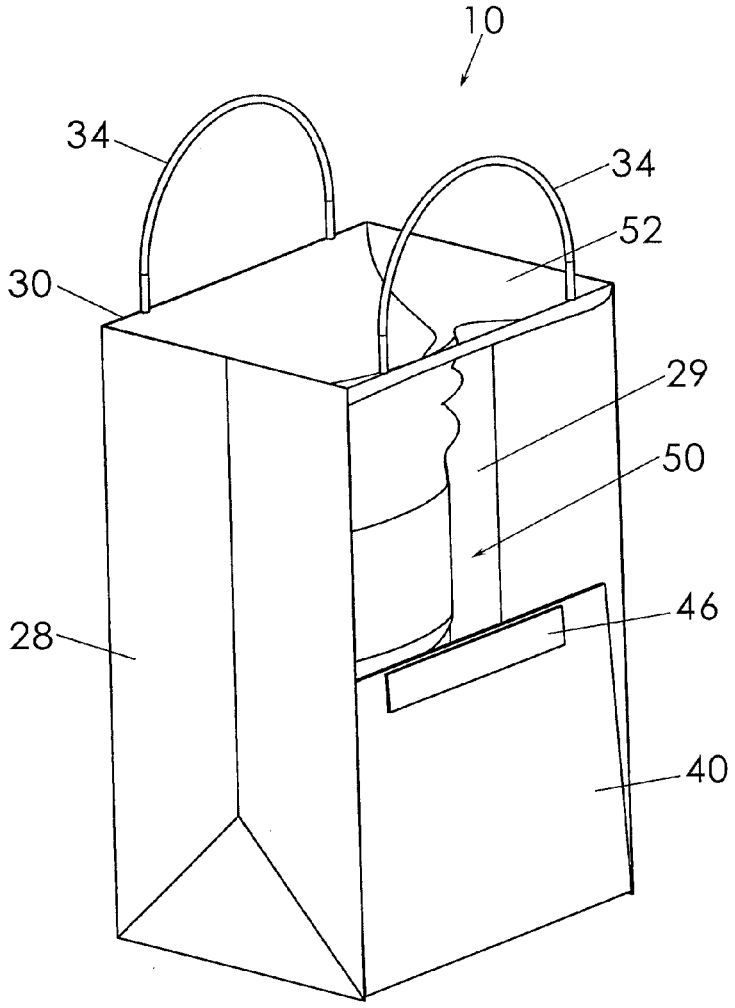
FIG. 8 is a perspective view of the apparatus from another angle and with a second side wall removed for clarity in showing the bottom panel in an open configuration and for showing an adhesive strip.

The bottom panel 40 is initially releasably coupled to an inner surface of one of the side walls of the housing 20. In other words, the bottom panel 40 is temporarily secured to a side wall—such as the second side wall 24—within the housing interior area from a point of manufacture and prior to use, such as with a light adhesive. As shown in FIG. 8, an adhesive strip 46 may be attached to a top surface of the bottom panel 40 and is configured to adhere to an inner surface of the second side wall 24. Of course, the adhesive strip 46 may alternatively be attached to the side wall itself for adherence to the bottom wall 40.

Figure 9A:
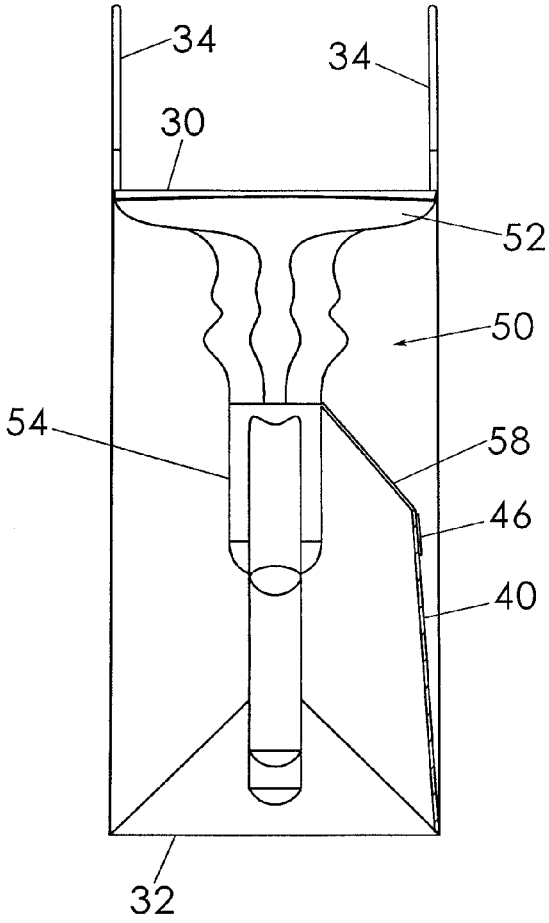
FIG. 9*a* an end view of the apparatus showing an embodiment that utilizes a band to couple the bottom panel to the collection portion of the collection member.
Figure 9B:
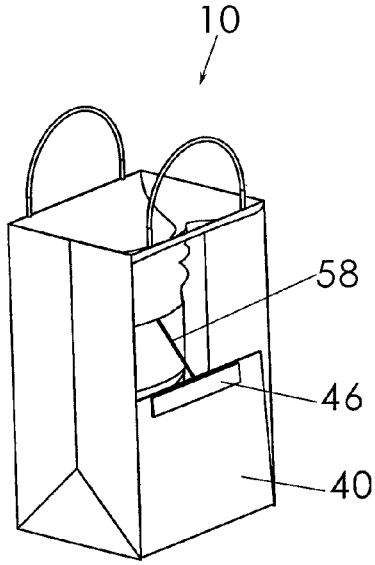
FIG. 9*b* is a perspective view of the apparatus as in FIG. 9*a*.

In addition, the bottom panel 40 is operatively coupled to the collection portion 54 of the collection member 50, such as with a paper band 58 or the like (FIG. 9*a*). In use, the band 58 is strong enough to pull the bottom panel 40 away from the side wall (i.e. to overcome the adhesive bond therebetween) yet weak enough to itself be detached or broken away from the bottom panel 40 as the collection portion 54 is moved from the retracted configuration (FIG. 2*a*) to the extended configuration (FIG. 2*b*) by the urging of a user's hand inside the collection portion/glove 54. In one embodiment, a light adhesive (not shown) situated between the bottom panel 40 and collection portion 54 may be used to initially connect the collection portion 54 and the bottom panel 40. In this embodiment, the bottom panel 40 may be detached from the side wall and from the collection portion 54 when the collection portion 54 (i.e. the glove) is urged outside of the interior area to its extended configuration (such as when used to collect animal waste).

It is understood that the bottom panel 40, however, does not immediately move to its closed configuration when detached from the side wall in that the bottom panel 40 is immediately adjacent the collection portion 54 as it is extended to its extended configuration which substantially fills the interior area and impedes movement of the open bottom 32 (FIG. 2*b*). However, when the collection portion 54 is returned to its retracted configuration (FIG. 2*a*), the bottom panel 40 is then free to fall by the force of gravity toward the closed configuration. It is understood that in manufacturing, the glove-like collection member 54 may be smaller than depicted in the patent drawings, making it easier for the bottom panel 40 to move toward the closed configuration.

Figure 6A:
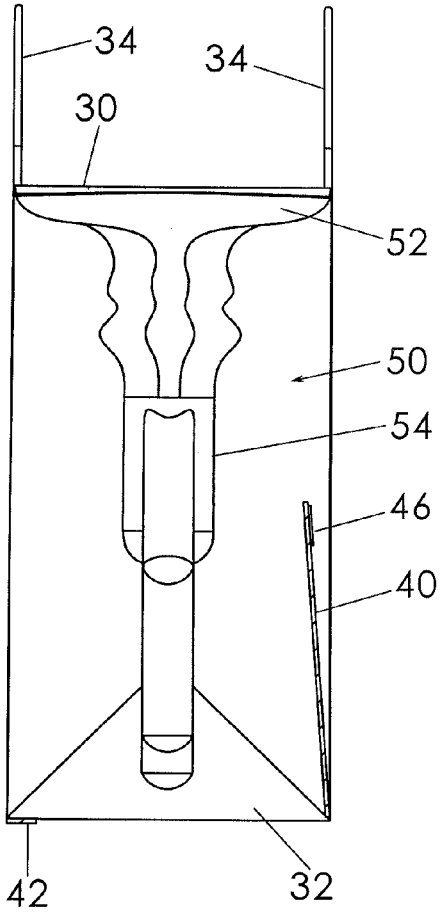
FIG. 6*a* is another end view of the apparatus as in FIG. 5 illustrating an embodiment utilizing a stop to prevent the bottom panel from extending past the housing open bottom.
Figure 7A:
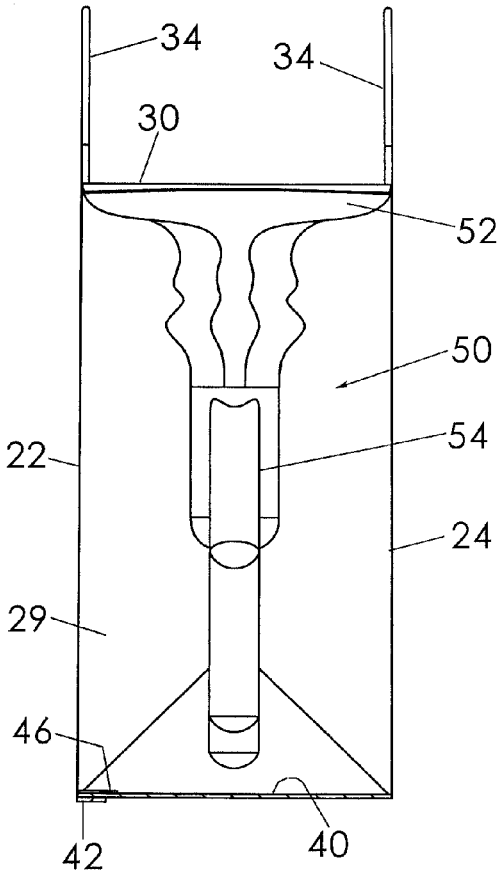
FIG. 7*a* is another end view of the apparatus as in FIG. 6*a* showing the bottom panel at a closed configuration resting upon the stop.

In one embodiment, the bottom panel 40 may be prevented from extending past the open bottom 32 of the housing 20 by a stop 42. More particularly, the stop 42 may be a tab that is coupled to a side or end wall of the housing 20 adjacent the open bottom 32 and extends inwardly so as to support the bottom panel 40 at the closed configuration (FIGS. 6*a* and 7*a*).

Figure 6B:
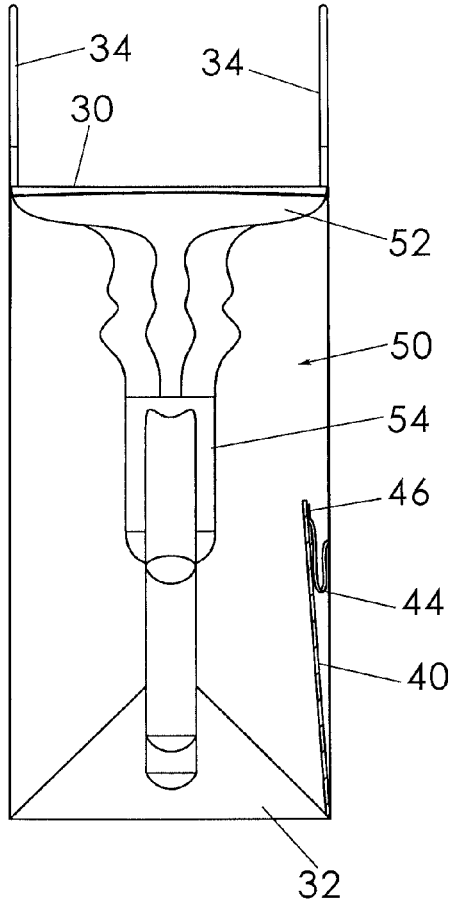
FIG. 6*b* is another end view of the apparatus as in FIG. 5 illustrating an embodiment utilizing a tether to prevent the bottom panel from extending past the housing open bottom.
Figure 7B:
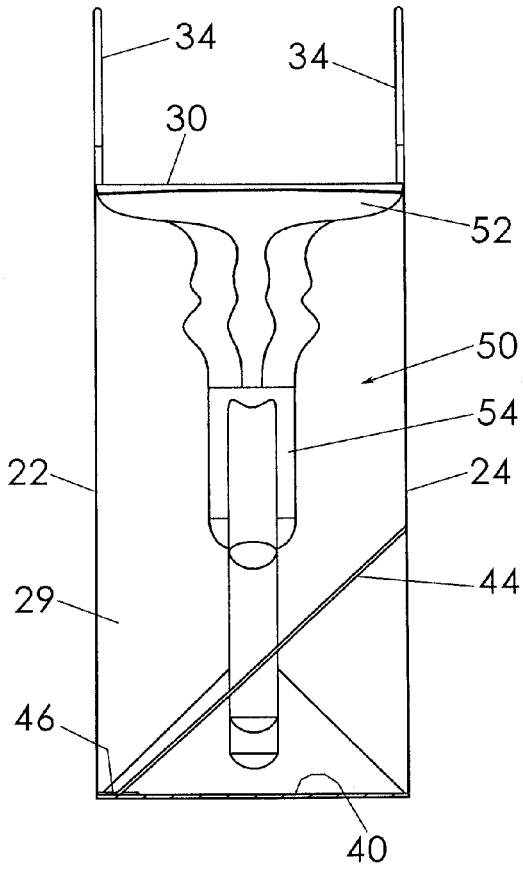
FIG. 7*b* is another end view of the apparatus as in FIG. 6*b* showing the bottom panel at a closed configuration and being held in position by the tether.

In another embodiment, the bottom panel 40 may be releasably coupled to the inner surface of a side wall as described above. In addition, the housing 20 may include a tether 44 having one end attached to the same side wall to which the bottom panel 40 is adhesively attached and another end attached to the bottom panel 40 (FIG. 6*b*). As described previously, the bottom panel 40 is coupled to the collection portion 54 of the collection member 50. Accordingly, the bottom panel 40 may be detached from the housing side wall when the collection portion 54 is moved to the extended configuration. When the collection portion 54 is then returned to the retracted configuration and the bottom panel 40 is allowed to move toward its closed configuration by force of gravity, the tether 44 extends to its full length to prevent the bottom panel 40 from extending past the open bottom 32 (FIG. 7*b*). It is understood that the tether 44 includes a length that enables the bottom panel 40 to extend to the closed configuration which covers and blocks the open bottom 32. Therefore, animal waste that has been collected may be deposited within the interior area and will rest upon the bottom panel 40 and will not fall out of the housing interior area.

Further, the housing 20 may include at least one handle 34 attached to the housing 20 that extends upwardly beyond upper edges of the side walls. For instance, a pair of handles 34 may include lower ends attached to first 22 and second 24 side walls that extend to upper ends extending upwardly of the housing 20, the handles 34 being configured to enable a user to carry the waste collection apparatus 10 until needed to collect animal waste and thereafter until the entire waste collection apparatus 10 may be disposed of.

In use, a user may carry a waste collection apparatus 10 by its handles 34 while in the collapsed configuration when walking his dog. Then, after the dog has had a bowel movement, the housing 20 may be moved to its expanded configuration so that the waste may be collected. The user may insert his hand into the glove-shaped collection portion 54 of the collection member 50, urge the collection portion 54 to its extended configuration outside the housing interior area, grasp the waste, and move the collection portion 54 back inside the housing interior area. As described above, extension of the collection portion 54 causes the bottom panel 40 to detach from the side wall to which it is adhesively attached. Then, when the collection portion 54 is retracted inside the interior area, the bottom panel 40 is free to move toward the closed configuration by the force of gravity, the bottom panel 40 being properly held at the closed configuration covering the open bottom 32 by either a stop 42 or the tether 44. The user may then release his grip on the waste and it may be deposited onto the bottom panel 40. The user may then remove his hand from the collection portion (i.e. glove) and the housing 20 may be carried by its handles until it may be thrown away.

It is understood that while certain forms of this invention have been illustrated and described, it is not limited thereto except insofar as such limitations are included in the following claims and allowable functional equivalents thereof.

The invention claimed is:

1. An animal waste collection apparatus, comprising:

a housing having opposed first and second side walls and opposed end walls extending between said side walls, respectively, said housing defining an open top, an open bottom, and an interior area;

a bottom panel pivotally coupled to a lower edge of one of said side walls and movable between an open configuration at which said bottom panel is positioned inside said housing interior area so as not to cover said open bottom and a closed configuration at which said bottom panel covers said open bottom;

a collection member having a mounting portion connected to an upper end of said housing and a collection portion extending downwardly from said mounting portion into said housing interior area, said collection portion being resiliently movable between a retracted configuration inside said housing interior area and an extended configuration extending outside said housing interior area through said open bottom, whereas so to be selectively manipulated by a user to collect animal waste;

wherein said collection member is configured to receive a hand of a user therein;

wherein said bottom panel is operatively coupled to said collection portion such that said bottom panel is moved automatically to said closed configuration when said collection portion is moved from said extended configuration to said retracted configuration.

2. The animal waste collection apparatus as in claim 1, wherein said mounting portion of said collection member is attached to respective upper edges of said opposed side walls and said opposed end walls so as to completely cover said housing member open top.

3. The animal waste collection apparatus as in claim 2, wherein said mounting portion and said collection portion are impermeable to liquid and air.

4. The animal waste collection apparatus as in claim 3, wherein said mounting portion and said collection portion are constructed of a plastic membrane material.

5. The animal waste collection apparatus as in claim 4, wherein:

said bottom panel is adhesively coupled to an inner surface of said first side wall at said open configuration; and said bottom panel is detached from said adhesive coupling when said collection portion is moved from said retracted configuration to said extended configuration.

6. The animal waste collection apparatus as in claim 2, wherein said collection portion is configured as a glove having five finger portions and defines an opening configured to receive a hand of a user into said collection portion.

7. The animal waste collection apparatus as in claim 1, wherein:

said bottom panel is adhesively coupled to an inner surface of said first side wall at said retracted configuration; and said bottom panel is detached from said adhesive coupling when said collection portion is moved from said retracted configuration to said extended configuration.

8. The animal waste collection apparatus as in claim 7, wherein said housing includes a stop attached to one of said side walls or said end walls of said housing adjacent said open bottom and configured to prevent said bottom panel from extending downwardly below said open bottom when said bottom panel is detached from said adhesive coupling.

9. The animal waste collection apparatus as in claim 7, wherein said housing includes a stop attached to one of said side walls or said end walls of said housing adjacent said open bottom and extending inwardly so as to support said bottom panel at said closed configuration.

10. The animal waste collection apparatus as in claim 7, wherein said housing includes a tether having one end attached to said inner surface of said second side wall and another end coupled to said bottom panel, said tether being configured to prevent said bottom panel from extending outside said housing interior area.

11. The animal waste collection apparatus as in claim 1, further comprising at least one handle attached to said housing and extending upwardly.

12. The animal waste collection apparatus as in claim 1, wherein said housing is foldable between a flat configuration and an expanded configuration.

13. A method for enabling a user to collect animal waste, comprising the steps of:

providing an animal waste collection apparatus that includes:

a housing having opposed first and second side walls and opposed end walls extending between said first and second side walls, respectively, said housing defining an open top, an open bottom, and an interior area;

a bottom panel pivotally coupled to a lower edge of one of said side walls and movable between an open configuration at which said bottom panel is positioned inside said housing interior area so as not to cover said open bottom and a closed configuration in which said bottom panel covers said open bottom;

a collection member having a mounting portion connected to an upper end of said housing and a collection portion extending downwardly from said mounting portion into said housing interior area, said collection portion being resiliently movable between a retracted configuration inside said housing interior area and an extended configuration extending outside said housing interior area through said open bottom, whereas so to be selectively manipulated by a user to collect animal waste;

wherein said collection member is configured to receive a hand of a user therein;

wherein said bottom panel is operatively coupled to said collection portion such that said bottom panel is moved automatically to said closed configuration when said collection portion is moved from said extended configuration to said retracted configuration;

inserting a user's hand through said housing open top into said collection portion;

the user extending said collection portion downwardly through said housing open bottom;

the user collecting an animal waste product with said collection portion;

the user retracting said collection portion with said collected animal waste product into said housing interior area;

the user moving said bottom panel to said closed configuration; and the user depositing the animal waste product onto said closed bottom panel.

* * * * *